United States Patent [19]

Vulich et al.

[11] 4,176,498

[45] Dec. 4, 1979

[54] APPARATUS FOR EDGING LENSES

[75] Inventors: Yordan Vulich, Oak Lawn; Wilfredo P. Loreto, Hoffman Estates, both of Ill.

[73] Assignee: AIT Industries, Inc., Schaumburg, Ill.

[21] Appl. No.: 879,146

[22] Filed: Feb. 21, 1978

[51] Int. Cl.[2] ..... B24B 9/14

[52] U.S. Cl. ..... 51/101 LG; 51/165.87

[58] Field of Search ..... 51/95 R, 101 LG, 127, 51/165.87

[56] References Cited

U.S. PATENT DOCUMENTS

| | | | |
|---|---|---|---|
| 845,687 | 2/1907 | Brown | 51/101 LG |
| 3,513,598 | 5/1970 | Asselin et al. | 51/101 LG |
| 3,798,844 | 3/1974 | Hannaman | 51/101 LG |
| 3,894,361 | 7/1975 | Georgiadis et al. | 51/101 LG |

FOREIGN PATENT DOCUMENTS

| | | | |
|---|---|---|---|
| 1420502 | 1/1976 | United Kingdom | 51/101 LG |

*Primary Examiner*—Harold D. Whitehead
*Assistant Examiner*—Robert P. Olszewski
*Attorney, Agent, or Firm*—Gary, Juettner & Pyle

[57] ABSTRACT

An apparatus for edging the periphery of an article, such as an ophthalmic lens to a predetermined outline or edge configuration, is characterized by a work holder for supporting and rotating a lens while moving an edge of the lens against a cylindrical grinding wheel. During grinding, the lens is engaged with only a portion of the grinding wheel, and to prevent a groove from being formed in the wheel successive lenses are automatically and periodically engaged with different portions of the wheel. In consequence, the wheel wears evenly, it retains a substantially cylindrical shape, all portions of its grinding surface are effectively used in grinding lenses, and the formation of a groove in its surface is prevented, whereby the wheel does not require retruing or reshaping and its useful life is significantly increased.

20 Claims, 4 Drawing Figures

APPARATUS FOR EDGING LENSES

BACKGROUND OF THE INVENTION

The present invention relates to an apparatus for grinding the peripheries of articles to a predetermined outline or edge configuration, and in particular to an apparatus for grinding the edges of lenses with a cylindrical grinding wheel in a manner which smoothly and evenly wears the grinding surface and significantly increases the useful life of the wheel.

The present invention is particularly adapted, but not necessarily limited, to be used in connection with an apparatus for grinding the periphery of eyeglass lenses. One such apparatus is shown in Canadian Pat. No. 776,380, issued Jan. 23, 1968. In the apparatus therein described, a lens is carried in a rotary work holder driven by a motor such that the edge of the lens may engage grinding wheels driven by another motor. The work holder is mounted on a carriage for movement toward and away from the grinding wheels, as well as in directions parallel to the axis of the wheels. The edge of the rotating lens is first brought against a cylindrical outer peripheral surface of a roughing wheel to rough grind the outer periphery of the lens to a desired shape. The lens is then shifted into engagement with a V-shaped groove of a beveling wheel to form a projecting bevel on the periphery of the lens. During the beveling operation, the work holder is rendered free to travel from side to side, in order that the edge of the lens will be automatically centered in the groove in the wheel. The resulting bevel on the edge of the lens enables or facilitates mounting of the lens in an eyeglass frame.

Although the work holder and lens are free to move axially of the beveling wheel during the beveling operation, it has been found that if axial movement is imparted to the lens during the roughing operation forces are exerted on the lens which often result in breaking, fracturing or chipping of the lens. During the roughing operation, therefore, the lens and the roughing wheel are restricted against axial movement with respect to each other. In consequence, with such conventional apparatus the edges of successive lenses are usually engaged with the same portion of the grinding surface of the roughing wheel, and a groove is formed in the surface.

Roughing wheels for grinding eyeglass lenses are usually comprised of an inner metal body having a cylindrical outer surface to which is bonded a layer of an abrasive material. The abrasive material, which ordinarily is diamonds in a metal matrix, has a thickness of about 0.1 inches, and defines the cylindrical grinding surface. The width of the surface is relatively large as compared with the thickness of the lenses, in order to ensure uniform contact with the entire edge surfaces of the lenses.

Although the groove forms relatively slowly in such wheels, after about 5,000 lenses have been edged the groove is ordinarily of a depth that requires retruing of the wheel. The surface of the wheel must then be reshaped or removed to the depth of the groove to again provide a cylindrical grinding surface on the wheel. Typically, such roughing wheels are capable of grinding only about 8,000 to 12,000 lenses before insufficient abrasive material remains to enable the wheel to be further retrued.

Not only are roughing wheels expensive because of the nature of the abrasive material, but retruing itself adds cost to the use of the wheels. In addition, since only the center area of the wheel is ordinarily employed in the grinding operation, the side areas are never used, and in fact are removed during retruing. Consequently, despite a considerable amount of diamond abrasive material being initially provided on the wheel, when the wheel is used in a conventional apparatus only a small portion of the material is ever actually used to grind lenses, and the remainder is wasted.

In an attempt to overcome the aforementioned disadvantages, one prior art technique contemplates providing manually operable means to axially orient the work holder and the roughing wheel relative to each other, so that the edges of lenses may be positioned to engage selected and different portions of the grinding surface. Ideally, an operator orients the lenses and roughing wheel relative to each other at a frequency and in a manner to cause even wear of the grinding surface. Unfortunately, in practice such orientation is usually neglected until a groove is visible in the surface, by which time the surface is already noncylindrical and requires reshaping. Even where the operator conscientiously changes the orientation of successive lenses with the wheel, it is unlikely that all of the various portions of the grinding surface will be engaged with a frequency and in a manner that evenly wears the wheel.

It would, therefore, be extremely desirable to provide some means for automatically orienting lenses and a roughing wheel relative to each other in a manner that provides even wear of the wheel and use of all of the abrasive material thereon, whereby to increase the number of lenses that may be ground and to eliminate the need to rely on an operator's observations of the wear characteristics of the wheel, all without the need to retrue the wheel.

OBJECTS OF THE INVENTION

An object of the present invention is to provide an apparatus for grinding disc-shaped articles with a cylindrical grinding wheel in a manner that smoothly and uniformly wears the entire grinding surface of the wheel.

Another object of the invention is to provide such an apparatus which prevents a groove from being formed in the grinding surface of the wheel.

A further object of the invention is to provide such an apparatus which significantly increases the number of articles that may be ground with the wheel during its useful life.

SUMMARY OF THE INVENTION

In accordance with the present invention, an apparatus for edging the peripheries of articles, such as the edges of optical lenses, comprises a grinding wheel having a cylindrical grinding surface, means for rotating the grinding wheel about its axis, and a work holder for supporting an article. Also provided are means for moving the work holder and the grinding wheel together to move an edge of the article into engagement with a portion of the grinding surface, means for rotating the article about its axis when its edge is against the grinding surface, and means for automatically periodically engaging the edges of at least some of the successive articles against different portions of the grinding surface to sequentially engage all portions of the surface with the edges of articles so that the surface wears evenly and uniformaly and maintains its cylindrical shape without a groove being formed therein.

In a preferred embodiment of the invention, the grinding wheel is secured against axial movement, and the periodic engaging means comprises drive means for shifting the work holder to periodically move successive articles axially of the grinding wheel prior to movement of the articles against the wheel, and means for controlling operation of the drive means. The control means advantageously comprises a counting circuit having an input and a plurality of outputs, means for applying an input signal to the input with each cycle of operation of the apparatus to edge an article, and an interconnect circuit for operating the drive means. The counting circuit sequentially generates an output signal at successive ones of its outputs upon each occurrence of an input signal, and the interconnect circuit is connected with the outputs and operates the drive means to position an edge of an article laterally opposite a selected portion of the grinding surface in accordance with the output providing the output signal.

More specifically, the drive means initially positions each article with its edge laterally opposite from a predetermined portion of the grinding surface, and the interconnect circuit is then responsive to the particular output providing the signal to either render the drive means inoperative, so that the moving means then engages the edge of the article with the predetermined portion of the grinding surface, or to operate the drive means to position the edge of the article laterally opposite from another portion of the grinding surface. The arrangement is such that the counting circuit and the interconnect circuit automatically and periodically cause the edges of articles to sequentially engage all portions of the grinding surface, whereby the surface is evenly worn.

The foregoing and other objects, advantages and features of the invention will become apparent from a consideration of the following detailed description, when taken in conjunction with the accompanying drawings.

DETAILED DESCRIPTION

Figure 1:
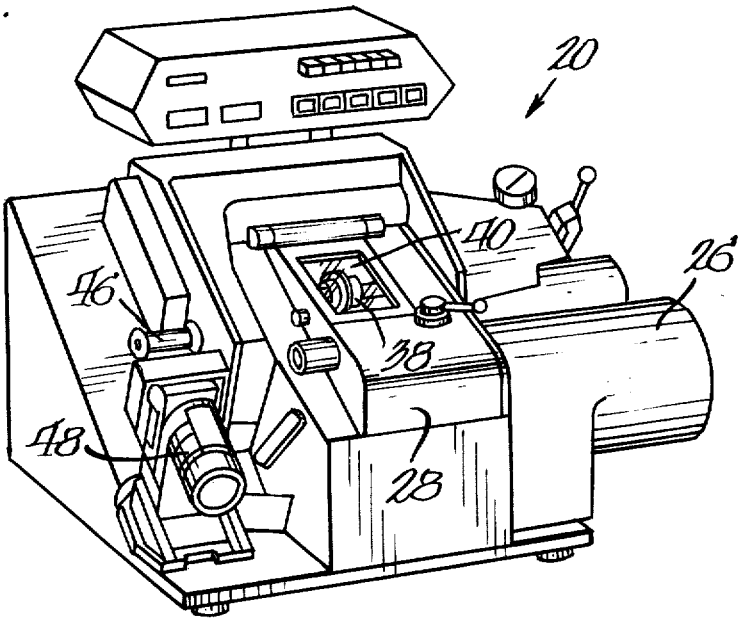
FIG. 1 is a perspective view of an apparatus for grinding the periphery of eyeglass lenses, of a type in which the teachings of the present invention may advantageously be incorporated.
Figure 2:
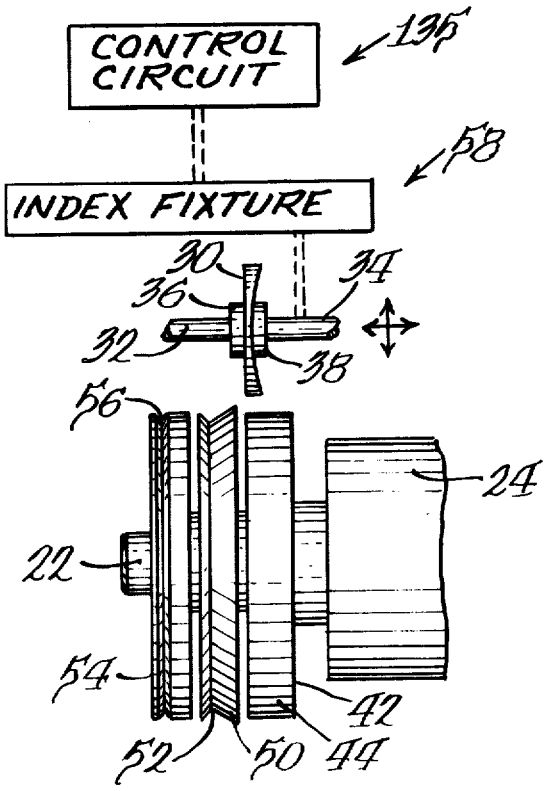
FIG. 2 is a highly schematic view of a lens held for movement against a roughing wheel and a pair of beveling wheels.

Referring to FIGS. 1 and 2, there is indicated generally at 20 an apparatus for grinding the edges or peripheries of articles, which in the embodiment of the invention shown and described comprise ophthalmic or eyeglass lenses. The apparatus includes a plurality of grinding wheels secured on a shaft 22 adapted to be driven at high speeds by a motor 24. The motor is confined within a housing portion 26 of the apparatus, and the grinding wheels are accessible through a cover 28.

A rotary work holder for supporting a lens 30 is mounted adjacent to the grinding wheels along an axis of rotation substantially parallel to that of the wheels. The work holder comprises a pair of axially aligned shafts 32 and 34 having respective opposed heads 36 and 38 that grip against the center of opposite faces of the lens, in order to hold the lens in proper position for grinding. Means are provided to rotate the work holder and to move the holder toward and away from the grinding wheels, as well as axially, as illustrated by the arrows in FIG. 2. The work holder is mounted within the apparatus and is accessible through a transparent window 40 in the cover 28, the window and cover normally being closed during grinding to protect an operator against flying chips and the like with the window allowing the lens to be viewed during grinding.

Referring in particular to FIG. 2, as is conventional in lens grinding apparatus a first one of the grinding wheels comprises a roughing wheel 42 having a cylindrical outer periphery 44 of an abrasive material which usually is comprised of diamonds in a metal matrix bonded or otherwise adhered to the wheel to a thickness on the order of 0.1 inches. In the manufacture of a lens for mounting in an eyeglass frame the lens, which usually is already ground and polished to a desired prescription, is mounted in the work holder and its edge moved into engagement with the grinding surface 44 while the work holder is rotated. Simultaneously, the work holder is moved toward and away from the roughing wheel in a controlled manner for grinding the edge of the lens to a predetermined outline in conformity with the configuration of the lens mounting openings in the eyeglass frame. Means for controlling movement of the work holder toward and away from the roughing wheel includes a pattern or cam 46 connected with the work holder for guiding its movement and having a configuration corresponding in shape to the desired outline of the lens, and an adjusting mechanism 48 for controlling the overall dimensions to which the lens is ground.

The width of the grinding surface 44 is ordinarily several times greater than the thickness of a lens, and with conventional lens grinding apparatus the work holder is usually axially positioned to engage the edges of lenses with the center of the surface. The result is that a groove is worn or formed centrally in the surface and the grinding surface loses its cylindrical shape. In consequence, the portions of the surface to either side of the center are not used in the grinding operation, the roughing wheel requires frequent retruing or reshaping to return its surface to cylindrical, and the useful life of the wheel is relatively short. In particular, such a roughing wheel when used in conventional lens grinding apparatus is capable of grinding only on the order of 8,000 to 12,000 lenses before it must be replaced, usually at considerable expense.

A second one of the grinding wheels is a beveling wheel 50 which has a relatively large V-shaped groove 52 in its outer periphery. The lens and the grinding wheels are supported in substantially parallel planes, and after the rough grinding operation the worker holder may be operated to move the edge of the rotating lens into the V-shaped groove. During the beveling operation the lens is rendered free to travel from side to side, in order that the edge of the lens will be automatically centered in the groove. The resulting bevel on the edge has an apex located about midway between the faces of the lens.

For relatively thin lenses, centering of the apex midway between the faces of the lens is acceptable, since the bevel is not likely to be visible from the front when the lens is mounted in an eyeglass frame. With thicker lenses, however, it is cosmetically desirable to provide a relatively small bevel adjacent the front side of the lens, in order that the bevel will not be visible from the front when the lens is mounted in a frame. For this purpose, a second beveling wheel 54, which has a relatively small V-shaped groove 56, is also provided. In the use of the wheel 54, after a relatively thick lens has been rough ground, and with the front of the lens facing left as shown in FIG. 2, the work holder moves the front edge of the rotating lens into the groove 56 while the lens is rendered free to travel from side to side. To ensure that the forward edge of the lens remains in the V-shaped groove, the lens is normally urged to the left and an arm (not shown) is engaged with the front face of the lens to deflect the lens and maintain its forward edge in the groove. In consequence, the bevel is formed on the lens around the side of the edge and adjacent to the front face thereof.

To the extent described, the apparatus is generally conventional, and in the usual use of the roughing wheel 42 a groove would be formed in the center of its grinding surface. In accordance with the teachings of the present invention, however, means are provided for automatically and periodically engaging the peripheries or edges of successive articles or lenses with selected and different portions of the grinding surface in a manner which effectively utilizes all portions of the surface. In consequence, the wheel wears evenly, formation of a groove in its surface is prevented, the need to retrue the wheel is eliminated, and the useful life of the wheel is significantly extended.

Figure 3:
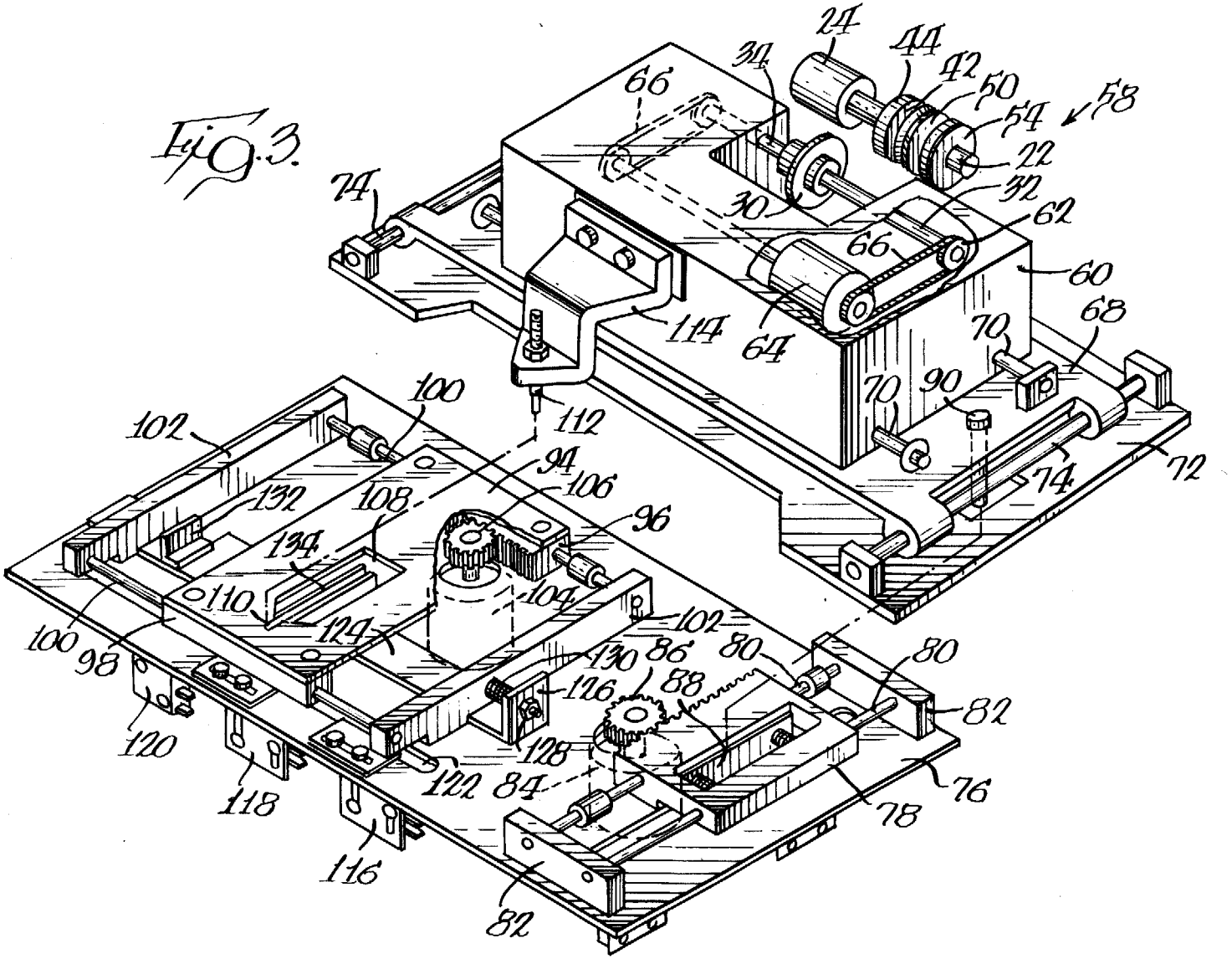
FIG. 3 is a perspective, partly fragmentary view of a carriage and work holder for moving the lens into and out of engagement with the wheels.

Referring to FIG. 3, there is shown one embodiment of an apparatus which may be used to grind lenses in accordance with the teachings of the invention. The apparatus includes a carriage assembly, indicated generally at 58, for supporting the work holder, and therefore the lens 30, for movement in directions parallel to the axis of the grinding wheels and in directions perpendicular to the axis laterally toward and away from the wheels, and means are provided for rotating the work holder. More specifically, the shafts 32 and 34 of the work holder are mounted parallel to the axis of the grinding wheels within a housing 60 in sprockets 62 for rotation by a motor 64 through a drive provided by a pair of chains 66. The housing is supported on a carriage 68 for movement from side to side on a pair of guide shafts 70 in directions parallel to the axis of the grinding wheels. To provide a self aligning guide support for the housing, the shaft toward the wheels is secured at each of its ends, whereas the rearward shaft is supported only at its center, the rearward shaft for this purpose having a pair of retaining rings at each of its ends. The carriage is in turn supported above a carriage support plate 72 for movement from front to rear on a pair of guide shafts 74 in directions laterally toward and away from the grinding wheels. Movement of the carriage on the carriage support plate, and of the housing on the carriage, thus enables composite movement of the work holder, and therefore of the lens, in directions parallel to and laterally of the axis of the grinding wheels.

A base 76, which is shown removed from the carriage assembly 58 for the purpose of clarity, is mounted on the carriage support plate 72 between the carriage support plate and the carriage 68, and includes means for moving the housing 60 from side to side on the carriage, and for moving the carriage from front to back on the carriage support plate. The means for moving the carriage includes a carriage rack 78 mounted for front to back movement on a pair of shafts 80 extended between a pair of support blocks 82. A motor 84 beneath the base has a gear 86 on an output shaft thereof which is meshed with a gear formation on the rack, and is energizable to move the rack on the shafts. The rack has a slot 88 in which is received a lower end of a pin 90 affixed to the carriage 68, the slot being elongate to accommodate front to back movement of the carriage during grinding of the periphery of the lens to a predetermined configuration. Movement of the carriage rack thus moves the carriage, and therefore the housing 60 and the work holder, from front to back in directions laterally toward and away from the grinding wheels.

Means for moving the housing 60 from side to side on the carriage 68 in directions parallel to the axis of the grinding wheels includes a plate 94 fastened at opposite ends to a float rack 96 and an index block 98. The float rack and the index block are mounted for movement on a pair of shafts 100 extended between a pair of support blocks 102, whereby the plate 94 is movable from side to side on the base 76. A motor 104 beneath the base has a gear 106 on an output shaft thereof which is meshed with a gear formation on the float rack, and is energizable to move the plate.

To transfer side to side movement of the plate 94 to the housing 60, an opening having an enlarged portion 108 and a relatively narrow necked down portion 110 is formed in the plate, and receives the lower end of a pin 112 secured with the housing through a bracket 114. To move the housing, and therethrough the work holder and lens, in directions parallel to the axis of the grinding wheels, the motor 84 is first energized to drive the carriage and housing backward on the carriage support plate 72 to move the pin 112 into the necked down portion 110 of the opening, the opening for this purpose being provided with tapered walls between the enlarged and the necked down portions to guide the pin into the necked down portion. With the pin nestled in the necked down portion, the motor 104 is then energized to move the housing from side to side on the carriage 68 in order to position the lens laterally opposite from a selected one of the grinding wheels, whereafter the motor 84 may again be energized to move the lens laterally into engagement with the wheel. To accurately control operation of the motor 104 in positioning the lens opposite a selected one of the grinding wheels, three electrical switches 116, 118 and 120 are fastened beneath the base 76 for being actuated by a cam element (not shown) fastened to the index block 98 and extended to beneath the base through an elongated slot 122. The switches 116, 118 and 120 control operation of the motor 104, and are adjusted to be actuated by the cam to stop the motor when the lens is positioned laterally opposite from the grinding wheels 54, 50 and 42, respectively.

As previously noted, during the beveling operation with either of the wheels 50 and 54, the work holder and the lens are rendered free for axial movement. This is provided by receiving the pin 112 in the enlarged portion 108 of the plate opening during beveling, which accommodates side to side movement of the pin and, therefore, like movement of the housing 60, the work holder and the lens.

Also as previously discussed, during the rough grinding operation the work holder and the lens are constrained against relative axial movement. This is necessary since it has been found that such relative movement during rough grinding usually results in destruction of the lens by breaking, fracturing or chipping.

The mounting of the roughing wheel constrains the wheel against movement along its axis. To prevent axial movement of the lens during rough grinding, an elongated roughing lock bar 124 is extended through slots formed in the support blocks 102 for sliding movement in directions parallel to the axis of the grinding wheels. An upstanding end 126 of the roughing lock bar has an opening through which is extended a fastener 128, one end of which is secured in the adjacent support block 102 and the other end of which has an enlarged head. A spring 130 is positioned around the fastener under compression between the support block and the upstanding end, whereby the roughing lock bar is normally urged rightwardly of the base 76, as shown in the drawings, but may be moved to the left against the urging of the spring.

A stop arm 132 extends upwardly beyond the plate 94 from an opposite end of the roughing lock bar, and a generally U-shaped pin guide 134 attached to the bar intermediate the end 126 and the stop arm extends laterally of the grinding wheels and perpendicular to their axis. The relative positions of the stop arm and the pin guide are such that when the plate 94 is moved to the left and engages the stop, the pin guide is aligned with the necked down portion 110 of the opening in the plate and extends beneath and medially of the enlarged opening 108. Engagement of the edge of the plate with the stop occurs prior to or upon actuation of the electrical switch 120, at which time the lens is positioned laterally opposite from the roughing wheel 42. Under this condition, upon movement of the lens toward the roughing wheel, the pin 112 leaves the necked down portion 110 and enters the pin guide, and is restrained therein against side to side movement, whereby axial movement of the lens with respect to the roughing wheel is prevented.

Without more, successive lenses would always be engaged with the same portion of the cylindrical grinding surface 44 of the rouhing wheel, and a groove would be worn into the wheel. To avoid this result, successive ones of the lenses are sequentially, or at least periodically, automatically indexed or reoriented axially with respect to the roughing wheel in order to engage selected and different portions of the grinding surface with the edges of the lenses in a manner which ensures uniform and even wear of the entire grinding surface.

In particular, the arrangement of the apparatus is such that the plate 94 engages the stop 132 immediately upon or just prior to actuation of the switch 120 to stop the motor 104. When the motor stops, and as shown in FIG. 2, the lens 30 is positioned laterally opposite from the roughing wheel 42 and is axially oriented to engage the left side of its grinding surface. The edge of the rotating lens may then be moved against the roughing wheel, whereby the leftmost portion of the grinding surface will be subject to wear. In the alternative, and perphaps if the previous lens had been ground by the left side of the grinding surface, the motor may momentarily be reenergized to further move the lens axially to a position laterally opposite from the center of the grinding surface, or even to a position opposite the right side of the surface. Successive lenses are similarly axially oriented with respect to the roughing wheel, if not sequentially then at least periodically, in a manner which successively engages the lenses with all portions of the grinding surface with a frequency to ensure uniform wear of the surface. In any event, and irrespective of whether the lens is positioned opposite the left, right or center portion of the roughing wheel, because of the stop 132 on the roughing lock bar 124 and the spring 130, upon engagement of the stop by the plate 94 the pin guide 134 is and remains aligned with the narrow necked down portion 110 of the opening in the plate. In this manner, upon movement of the lens against the roughing wheel axial movement of the lens with respect to the wheelis prevented irrespective of the particular axis orientation of the lens with respect to the wheel.

Figure 4:
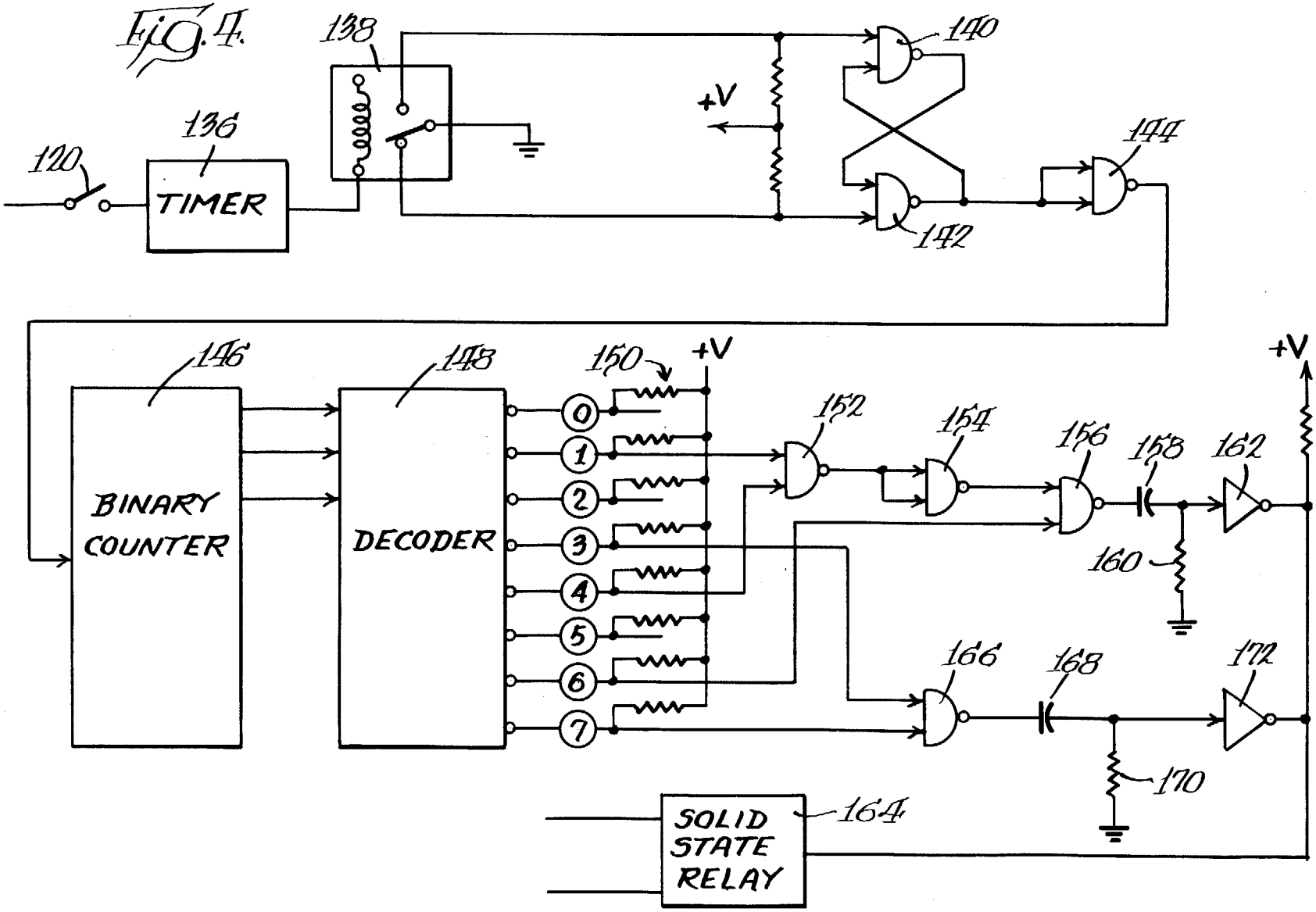
FIG. 4 is a schematic illustration of a circuit for controlling operation of the carriage shown in FIG. 3.

Means for controlling the axial orientation of successive lenses with respect to the roughing wheel may advantageously comprise a circuit of a type shown in FIG. 4 and indicated generally at 135. In that circuit, a contact of the switch 120 is connected to apply an input to a timer 136 each time the switch is actuated to stop the motor 104 upon leftward movement of the plate 94 (as shown in FIG. 3), at which point the lens is positioned laterally opposite the leftmost portion of the roughing wheel (as shown in FIG. 2). After a predetermined delay, which enables other components of the apparatus to complete their cycles of operation, an output from the timer is applied to a relay 138. The relay is connected with three NAND gates 140, 142 and 144, and in the absence of an output from the timer a negative or ground level signal is provided at an output from the NAND gate 144. Upon the occurrence of an output from the timer, however, the output from the NAND gate 144 becomes positive and is applied as an input to a counting circuit including a binary counter 146. In the embodiment of the circuit shown the binary counter has three outputs, individual ones of which are either at ground or are positive in accordance with the level of the stored count. The outputs from the counter are applied as inputs to a decoder circuit 148, which for the embodiment of the invention shown has eight outputs, a selected one of which is at ground potential in accordance with the value of the input from the counter. The arrangement is such that upon each closure of the switch 120 the ground level is present at a successive and sequential output from the counting circuit decoder, while the remaining outputs are at a positive potential as a result of a positive voltage applied through an associated one of a plurality of resistors, indicated generally at 150.

The outputs numbered 1, 4 and 6 from the decoder 148 are connected as inputs to an interconnect circuit including three NAND gates 152, 154 and 156, which are arranged so that whenever a ground level is present at one of the outputs a positive voltage is provided from the NAND gate 156 and applied to a first timing circuit comprising a capacitor 158 and a resistor 160. When this occurs, a ground level is provided at an output from an inverting amplifier 162 and applied as an input to a solid state relay 164 to actuate the relay for a period of time determined by the time constant of the capacitor 158 and the resistor 160.

The outputs numbered 3 and 7 from the decoder are applied as inputs to a NAND gate 166 of the interconnect circuit, the output from which is applied through a second timing circuit comprising a capacitor 168 and a resistor 170 to an input to an inverting amplifier 172. Thus, whenever one of those decoder outputs goes to ground, a ground level signal is applied by the amplifier 172 to the input to the relay 164 to actuate the relay for a period of time determined by the time constant of the capacitor 168 and the resistor 170. The remaining outputs numbered 0, 2 and 5 from the decoder are not connected with any of the NAND gates 152, 154, 156 and 166, and therefore upon any one of those outputs going to ground the relay is not actuated.

The outputs from the relay 164 is connected to operate the motor 104 to move the work holder and the lens 30 axially of the grinding wheels for as long as the relay is energized. As discussed, each time that the switch 120 is actuated to deenergize the motor 104, the lens is axially oriented with its edge positioned laterally opposite from the leftmost surface portion of the grinding surface 44 of the roughing wheel. Consequently, whenever one of the outputs numbered 0, 2 or 5 from the decoder 148 is at ground potential after actuation of the switch, the relay is not energized and the motor 104 remains off. Under this condition, subsequent movement of the lens laterally against the roughing wheel engages the edge of the lens with the leftmost portion of the grinding surface.

In the case where one of the outputs numbered 1, 4 or 6 from the decoder is at ground potential after actuation of the switch 120, an output from the amplifier 162 actuates the relay 164 to reenergize the motor 104 for a period of time determined by the values of the capacitor 158 and the resistor 160. To this end, the values of the capacitor and the resistor are selected to energize the motor for a period of time which further moves the lens axially of the roughing wheel to a position whereat the edge of the lens is positioned laterally opposite from the rightmost portion of the grinding surface of the wheel. Upon a ground being provided at one of the outputs numbered 3 or 7 from the decoder, the motor is similarly energized to further move the lens axially of the roughing wheel, but in this case the relative values of the capacitor 168 and the resistor 170 are selected to provide an operating time for the motor which moves the lens to a position laterally opposite the center of the wheel.

As illustrated in FIG. 2, the width of the grinding surface 44 of the roughing wheel is approximately three times as great as the average thickness of the edge of a lens. Accordingly, for the embodiment of the invention disclosed, three discrete axial orientations of the lens with respect to the roughing wheel have been provided. It is understood, of course, that for other dimensional relationships of lenses and roughing wheels more or fewer such axial positions could be provided, the important criteria not necessarily being the precise number of positions, but rather the provision of such positions in order to engage all grinding surface areas of the roughing wheel with the lenses in a manner which ensures uniform wear of the wheel, maintains the cylindrical configuration of the grinding surface, and prevents the formation of a groove therein.

To this end, the outer side edges of a roughing wheel used to grind lenses wear away at a considerably slower rate than the inner centrally located areas of the grinding surface. This occurs both as a result of the curve of a lens and because its edge ordinarily does not lie in a single plane. Consequently, when the lens is rotated and ground its edge both undulates on the grinding surface and to a limited extent moves thereacross. Thus, even when the lens is positioned to engage a side edge of the grinding surface, its movement carries it at least partially over the center portion of the surface, whereby the center tends to wear faster than the sides of the wheel. As a matter of fact, it has been observed that the outer side areas of the grinding surface are eroded at a rate of only about one-half to three-quarters as fast as the inner areas. Therefore, in order to provide uniform wear of the roughing wheel, greater numbers of lenses ideally should be ground with the side edge areas of the wheel than with the center areas.

With the foregoing in mind, and referring again to FIG. 4, it is seen that the outputs from the counting circuit decoder 148 are arranged to energize the motor 104 in a manner which axially orients lenses to opposite from each of the left and the right sides of the roughing wheel more often than to opposite from the center of the wheel. In particular, the circuit causes positioning of lenses relative to the grinding surface of the wheel as follows: left, right, left, center, right, left, right and center, whereupon the sequence is repeated for successive lenses. This sequence has been found, for the case where the roughing wheel is approximately three times as wide as the average thickness of a lens, to provide for very uniform and even wear of the roughing wheel.

It is understood, of course, that it is not necessary to preselect a sequence of discrete axial orientations of the lens relative to the roughing wheel. Instead, the lens could be randomly oriented, provided that the process caused engagement of all portions of the grinding surface with a frequency promoting uniform wear of the surface. In addition, the axial orientations need not necessarily occur in increments equal to the edge thickness of a lens, but may be in greater or lesser increments, the criteria for any selected mode of lens indexing or orienting being the same, namely, periodic engagement of different portions of the grinding surface in a manner which causes uniform wear of the surface.

The invention thus provides an improved apparatus for edging optical lenses, in which the life of the cylindrical rough grinding wheel has been significantly extended. By virtue of successive lenses being periodically positioned to engage different portions of the surface of the wheel, as compared with always being brought into engagement with the same portion of the surface as is generally conventional, the grinding wheel wears smoothly and evenly, retruing is not required, and the useful life of the wheel is significantly extended. Also, by virtue of the positioning being under automatic as compared with manual control, operator discretion in positioning the lens is eliminated, and periodic reorientation of lenses is always accomplished in a manner and at a frequency to ensure even wear of the grinding wheel. In particular, while such a grinding wheel when used in a conventional manner may be expected to grind only on the order of 10,000 lenses during its useful life, the same wheel when used to grind lenses in accordance with the teachings of the invention can reasonably be expected to grind on the order of 25,000 or more lenses. Consequently, the invention advantageously results in improved life of grinding wheels, a lower expense for such wheels, and elimination of down time of edging apparatus for the purpose of retruing the wheels.

A further advantage provided by the invention is an extended life of the beveling wheels. Since the roughing wheel wears evenly and maintains a cylindrical surface, lenses ground therewith have axially flat edges. When such a lens is beveled, the flat edge of the lens is removed by the two angular faces of the V-shaped beveling groove, and the apex of the groove removes a minimum of material and retains its shape. In the case of lenses ground with a grooved roughing wheel, however, the edge of the lens is not axially flat, but instead conforms in shape with the groove. In consequence, when lenses of this edge configuration are beveled, the apex of the V-shaped beveling groove removes a considerable amount of material and is subject to excessive wear, resulting in a shortened useful life of the beveling wheel.

Also, since the surface of the roughing wheel remains axially flat, the distances between the axis of rotation of a lens and all laterally opposite portions of the grinding surface are the same. Thus, irrespective of the particular axial orientation of lenses with respect to the grinding wheel, the peripheries of successive lenses may readily be ground to precisely determined overall dimensions, which is extremely desirable for conformably fitting optical lenses within specifically dimensioned openings in eyeglass frames.

While embodiments of the invention have been described in detail, various modifications and other embodiments thereof may be devised by one skilled in the art without departing from the spirit and the scope of the invention, as defined by the appended claims.

What is claimed is:

1. An apparatus for grinding the peripheries of articles such as optical lenses and the like, comprising a grinding wheel having a grinding surface, means for rotating said grinding wheel about its axis, means for supporting an article, means for moving said supporting means and said grinding wheel together to move the periphery of the article into engagement with a portion which is less than the entirety of said grinding surface, means for rotating the article about an axis while its periphery is against only said portion of said grinding surface, and means operative in response to successive articles being ground for operating said moving means to automatically periodically engage the peripheries of at least some of the successive articles against different portions each of which is less than the entirety of said grinding surface to sequentially engage all portions of said surface with the peripheries of articles so that said surface wears evenly and uniformly.

2. An apparatus for grinding the peripheries of articles as set forth in claim 1, including means for securing the article and said grinding wheel against relative movement along their axes of rotation while the same are engaged, said means for operating said moving means including control means indexical through successive stages in response to successive articles being ground for operating said moving means to engage each article with a selected portion of said grinding surface in accordance with the present stage of said control means.

3. An apparatus for grinding the peripheries of articles as set forth in claim 2, said grinding wheel having a cylindrical grinding surface, said supporting means supporting each article with its axis of rotation generally parallel to the axis of said grinding wheel, said means for moving maintaining said axes substantially parallel.

4. An apparatus for grinding the peripheries of articles as set forth in claim 2, said moving means shifting said support means and said grinding wheel relative to each other to move an article and said grinding wheel relative to each other along their axes of rotation and to a selected orientation in accordance with the present stage of said control means prior to said moving means bringing the articles and said grinding wheel together.

5. An apparatus for grinding the peripheries of articles as set forth in claim 2, said grinding wheel being secured against axial movement, said moving means being responsive to the stages of said control means to shift said support means to move at least some of the successive articles generally along their axes of rotation to selected positions relative to said grinding wheel prior to said moving means bringing each article and said grinding wheel together, said moving means moving each article and said grinding wheel laterally together.

6. An apparatus for grinding the peripheries of articles as set forth in claim 5, said moving means including drive means connected with said support means for moving the same in directions generally parallel to the axis of said grinding wheel, said moving means operating means controlling operation of said drive means, said moving means operating means being automatically responsive to successive articles being ground to operate said drive means to periodically move at least some of the successive articles to position their peripheries laterally opposite from different portions of said grinding surface, so that all portions of said grinding surface are periodically engaged with the peripheries of articles and said surface wears evenly.

7. An apparatus for grinding the peripheries of articles as set forth in claim 6, said means for operating said moving means operating said drive means to initially position each article with its periphery laterally opposite from a predetermined portion of said grinding surface, said means for operating being responsive to successive articles being ground to periodically thereafter operate said drive means to reposition the peripheries of some but not all of the successive articles laterally opposite selected and different portions of said grinding surface, so that all portions of said grinding surface are periodically engaged with the peripheries of articles.

8. An apparatus for grinding the peripheries of articles as set forth in claim 6, said means for operating said moving means comprising circuit means having an input and an output, and means for applying an input signal to said input with each cycle of operation of said apparatus to grind an article, said output being connected with said drive means and providing thereto a signal having a value in accordance with the number of input signals applied to said input, said drive means being responsive to the value of said signal to move said support means to position the peripheries of articles laterally opposite from selected portions of said grinding surface.

9. An apparatus for grinding the peripheries of articles as set forth in claim 6, said means for operating said moving means comprising first circuit means having an input and a plurality of outputs, means for applying an input signal to said input with each cycle of operation of said apparatus to grind an article, and second circuit means connecting said outputs with said drive means, said first circuit means providing an output signal at a selected one of said outputs in accordance with the number of inputs signals applied to said input, said second circuit means operating said drive means to move said support means to position the peripheries of articles laterally opposite selected portions of said grinding surface in accordance with the particular output providing said output signal.

10. An apparatus for grinding the peripheries of articles as set forth in claim 6, said means for operating said moving means comprising counting circuit means having an input and a plurality of outputs, means for applying an input signal to said input with each cycle of operation of said apparatus to grind an article, said counting circuit means generating an output signal at successive ones of said outputs upon each occurrence of said input signal, and interconnect circuit means for operating said drivemeans, said interconnect circuit means being connected with said outputs and operating said drive means to position the peripheries of articles laterally opposite from selected portions of said grinding surface in accordance with the particular output providing said output signal.

11. An apparatus for grinding the peripheries of articles as set forth in claim 10, said means for operating said moving means including means for operating said drive means to initially position each article with its periphery laterally opposite from a predetermined portion of said grinding surface, said interconnect circuit means being responsive to said output signal being at a selected one of at least one but less than all of said outputs to thereafter render said drive means inoperative so that said moving means then engages the periphery of an article with said predetermined portion of said grinding surface, said interconnect circuit means being responsive to said output signal being provided at one of the remaining outputs to operate said drive means to position the peripheries of articles laterally opposite from other portions of said grinding surface, said other portions being determined by the particular output providing said output signal, said counting circuit means and said interconnect circuit means periodically causing the peripheries of articles to sequentially engage all portions of said grinding surface.

12. An apparatus for edging lenses, comprising a grinding wheel having a cylindrical grinding surface, means for rotating said grinding wheel about its axis, a work holder for supporting a lens along an axis thereof which is substantially parallel to the axis of said grinding wheel, means for orienting said work holder and said grinding wheel to position the edge of each successive lens laterally opposite from a selected portion which is less than the entirety of said grinding surface, means for moving said work holder and said grinding wheel laterally together while maintaining the axes of the lens and of said grinding wheel substantially parallel to move the edge of the lens against said selected portion of said grinding surface, means for securing the lens and said grinding wheel against relative movement along their axes while the same are moved together and engaged, means for rotating said work holder to rotate the lens about its axis while the lens is moved against only said selected portion of said grinding surface, and means operative in response to successive lenses being edged for operating said orienting means to automatically periodically reorient said work holder and said grinding wheel to position the edges of at least some of the successive lenses laterally opposite from different selected portions each of which is less than the entirety of said grinding surface prior to movement of the lens against said grinding surface, so that the edges of successive lenses are periodically engaged with different portions of said grinding surface and sequentially engage all portions of said surface, whereby said grinding surface wears evenly and uniformly and maintains a substantially cylindrical shape.

13. An apparatus for edging lenses as set forth in claim 12, said means for orienting said work holder and said grinding wheel moving said work holder to initially position the edge of each successive lens laterally opposite from a predetermined portion of said grinding surface, said means for operating said orienting means then periodically operating said orienting means to move at least some of the successive lenses from said initial orientation to reposition the edges thereof laterally opposite from different selected portions of said grinding surface.

14. An apparatus for edging lenses as set forth in claim 13, said predetermined portion of said cylindrical grinding surface being adjacent to one side edge thereof, said orienting means operating means moving the lens toward an opposite side edge of said grinding surface.

15. An apparatus for edging lenses as set forth in claim 13, said orienting means operating means moving said work holder to position successive lenses at discrete positions with their edges laterally aligned with selected portions of said grinding surface, said discrete positions having a spacing which is less than or equal to the average edge thickness of the lenses along their axes.

16. An apparatus for edging lenses as in claim 12, said orienting means operating means positioning the edges of successive lenses to engage side edge portions of said grinding surface more often than portions between said side edge portions.

17. An apparatus for grinding the peripheries of optical lenses, comprising a grinding wheel having a grinding surface; means for rotating said grinding wheel about its axis; means for supporting a lens; means for moving said supporting means and said grinding wheel relative to each other to move the periphery of the lens into engagement with a discrete portion which is less than the entirety of said grinding surface to grind the lens; and means operative in response to successive lenses being ground for controlling operation of said moving means to automatically periodically engage the peripheries of at least some of the successive lenses against different discrete portions each of which is less than the entirety of said grinding surface to sequentially engage all portions of said surface with the peripheries of lenses in a manner and at a frequency so that said surface wears evenly and uniformly, said means for controlling operation of said moving means including means indexical through predetermined stages, and means operative in response to successive lenses being ground for advancing said indexical means through said predetermined successive stages, said stages of said indexical means being at least equal in number to the number of discrete portions of said grinding surface and individually representative thereof, said indexical means being coupled with and controlling operation of said moving means to position each successive lens against a discrete portion of said grinding surface selected in accordance with the present stage of said indexical means.

18. An apparatus as in claim 17, including means for rotating said lens about an axis while its periphery is against only said discrete portion of said grinding surface.

19. An apparatus as in claim 17, said means for advancing said indexical means advancing said indexical means to a successive stage in response to each successive lens being ground.

20. An apparatus as in claim 17, said indexical means comprising circuit means having an input and a plurality of outputs equal in number to the number of said stages and individually representative of said discrete portions of said grinding surface, said circuit means in response to successive input signals thereto cyclically generating a signal at individual and successive ones of its outputs, said means for advancing including means for applying an input signal to said circuit means in response to each successive lens being ground, said circuit means being coupled with said moving means for controlling operation of the same to move each successive lens against a discrete portion of said grinding surface selected in accordance with the particular output whereat said output signal is then being generated.

* * * * *